United States Patent [19]

Estkowski et al.

[11] Patent Number: 4,892,354

[45] Date of Patent: Jan. 9, 1990

[54] CHAIR SEAT TILT CONTROL

[75] Inventors: Michael H. Estkowski; Don E. Minor, Coloma, both of Mich.; Lennard V. Lastuck, Gramger, Ind.

[73] Assignee: Shepherd Products U.S., Inc., St. Joseph, Mich.

[21] Appl. No.: 374,269

[22] Filed: Jun. 30, 1989

[51] Int. Cl.[4] ..... A47C 3/00

[52] U.S. Cl. ..... 297/301; 248/575; 297/302; 297/304

[58] Field of Search ..... 297/300, 301, 302, 303, 297/304, 305, 306, 285; 248/575

[56] References Cited

U.S. PATENT DOCUMENTS

| | | | |
|---|---|---|---|
| 4,214,726 | 7/1980 | Karrip | 248/575 |
| 4,438,898 | 3/1984 | Knoblauch et al. | 297/304 |
| 4,570,895 | 2/1986 | Whitwan | 248/575 |
| 4,685,733 | 8/1987 | Machate et al. | 297/301 |
| 4,720,142 | 1/1988 | Holdredge et al. | 297/300 |
| 4,744,600 | 5/1988 | Inoue | 248/575 |

*Primary Examiner*—James T. McCall

*Attorney, Agent, or Firm*—Lee, Mann, Smith, McWilliams & Sweeney

[57] ABSTRACT

A seat support mechanism for a tiltable chair having a rear tilt torque mechanism including interconnected torsion bars which are adjustable to vary the resilient restraining force which opposes rearward tilt of the seat when occupied, a detent mechanism which provides additional detent and stability to maintain the seat in its normal upright position and add to the resistance of the torque mechanism, and an adjustment mechanism for adjusting said detent mechanism for front tilt.

6 Claims, 5 Drawing Sheets

182
180
170
168
178
162
174
166
176
184
76
160
190
154
74
116b
116a
126
138
134
136
80
104
86c
86
86b
86a
124
144
128
102
120
118
114A
115
114B
110
112
108
84
90
78
88
82
122
142
156
158
186
150
140
159
146
148
152

CHAIR SEAT TILT CONTROL

BACKGROUND OF THE INVENTION

The present invention is directed to seat support mechanisms for tiltable chairs of the type commonly found in offices. Numerous arrangements of this type are found in the prior art U.S. Pat. Nos. 2,991,125, 3,131,904, 3,480,249, 3,592,433, 3,868,144, 4,295,626 and 4,718,726. None of these arrangements disclose the features of the present invention.

SUMMARY OF THE INVENTION

The present invention provides a support mechanism for a tiltable chair including a seat support assembly adapted to be mounted to the underside of a chair seat. The support assembly includes a pair of side plates having a tube rotatably supported between the front ends thereof. A U-shaped channel connects the rear ends of the side plates. A rear tilt torque mechanism including a first torsion bar and a second torsion bar is provided. The first torsion bar extends through the tube and is nonrotatably supported within one end thereof and rotatably supported within the other end. The second torsion bar is rotatably supported in the U-channel. The first and second torsion bars are interconnected via brackets and adjustment of the resilient restraining force which opposes rearward tilt of the seat when it is occupied may be effected by an adjustment knob. A base member is rigidly secured at its front end to a support assembly tube. The rear end of the base member is adapted to receive a chair post which furnishes primary support for the chair and seat. The base member is provided with a detent mechanism which interconnects with the support assembly and is adjustable. The detent mechanism provides additional stability to the chair seat when it is in its normal upright position.

DETAILED DESCRIPTION OF THE INVENTION

Figure 1:
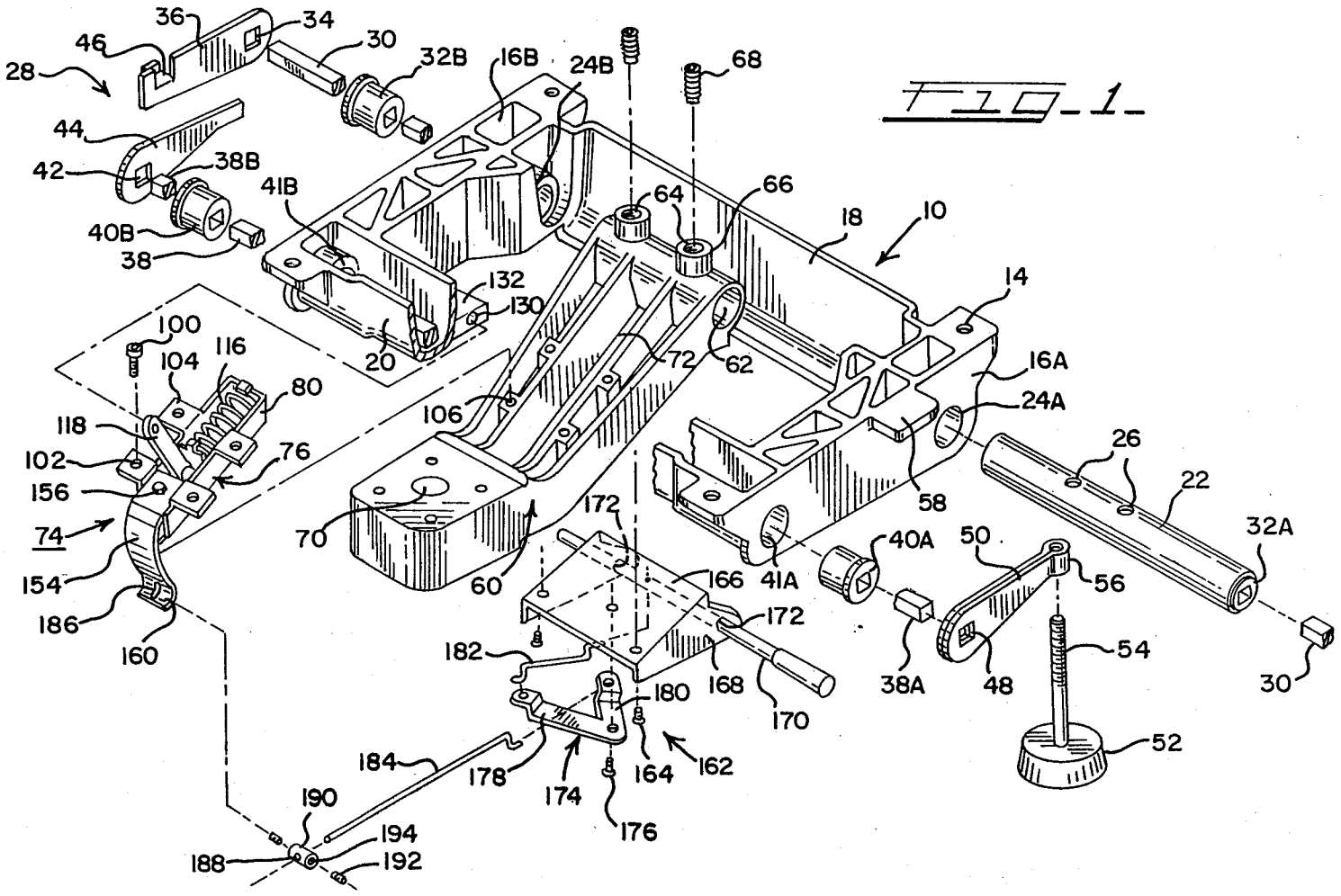
FIG. 1 is an exploded perspective view showing the elements of the support mechanism of the present invention.

A support mechanism for a tiltable chair is shown in exploded view in FIG. 1. The support mechanism includes a seat support assembly 10 adapted to be mounted to the underside of a chair seat 12 shown in FIGS. 4–6 through apertures 14 provided therein. The support assembly 10 is shown as an integral structure including a pair of side plates 16A and 16B connected at the front end by a generally J-shaped support 18 and at the rear end by a generally U-shaped channel 20. A tube 22 having a central axis is rotatably positioned within sleeves 24A and 24B formed at the front ends of the side plates 16A and 16B. A pair of apertures 26 are provided through the tube 22.

A rear tilt torque mechanism 28 includes a first torsion bar 30 which extends through the tube 22. A bushing 32A nonrotatably supports one end of the first torsion bar 30 within one end of tube 22 and another bushing 32B rotatably supports the other end of torsion bar 30 within sleeve 24B which also supports the other end of tube 22. The end of the first torsion bar 30 which is rotatably supported in the bushing 32B extends outwardly therefrom and is secured in an aperture 34 defined in a first bracket 36.

A second torsion bar 38 is rotatably suported within the U-shaped channel 20 by a pair of bushings 40A and 40B which are rotatably supported in corresponding sleeves 41A and 41B, respectively, defined at each end of the channel 20. One end 38B of torsion bar 38 extends outwardly from the bushing 40B and is secured in an aperture 42 defined in a second bracket 44. The free end of the bracket 44 is adapted to rest on a platform 46 which extends from bracket 36 so that the brackets 36 and 44 are interconnected. The opposite end 38A of the torsion bar 38 extends outwardly from the bushing 40A and is secured in an aperture 48 defined in a lever 50. The lever 50 is rotatable with the second torsion bar 38. An adjustment knob 52 is connected to a threaded element 54 which is threadably received within a collar 56 provided at the free end of the lever 50. When the knob 52 is rotated, the threaded element 54 advances within the collar 56 until the tip of the element 54 engages the underside of a flange 58 which extends outwardly from the top of side plate 16A. Rear pivot of the support assembly 10 about the tube 22 is opposed by the second bracket 55 engaging the first bracket 36. The extent to which rotation takes place is a function of the load exerted on the seat and the torsion characteristics of the torsion bars 30 and 38.

A base member 60 is provided for mounting of the support assembly 10. The front end of the base member 60 is provided with a cylindrical sleeve 62 through which the tube 22 extends. A pair of apertures 64 are provided through the sleeve 62 and each aperture 64 has an annular collar 66 concentric therewith and extending outwardly from the sleeve 62. The apertures 64 are sized and spaced to correspond with the tube apertures 26. Screws 68 threaded through the sleeve apertures 64 and into the tube apertures 26 rigidly secure the base member 60 to the tube 22.

Figure 4:
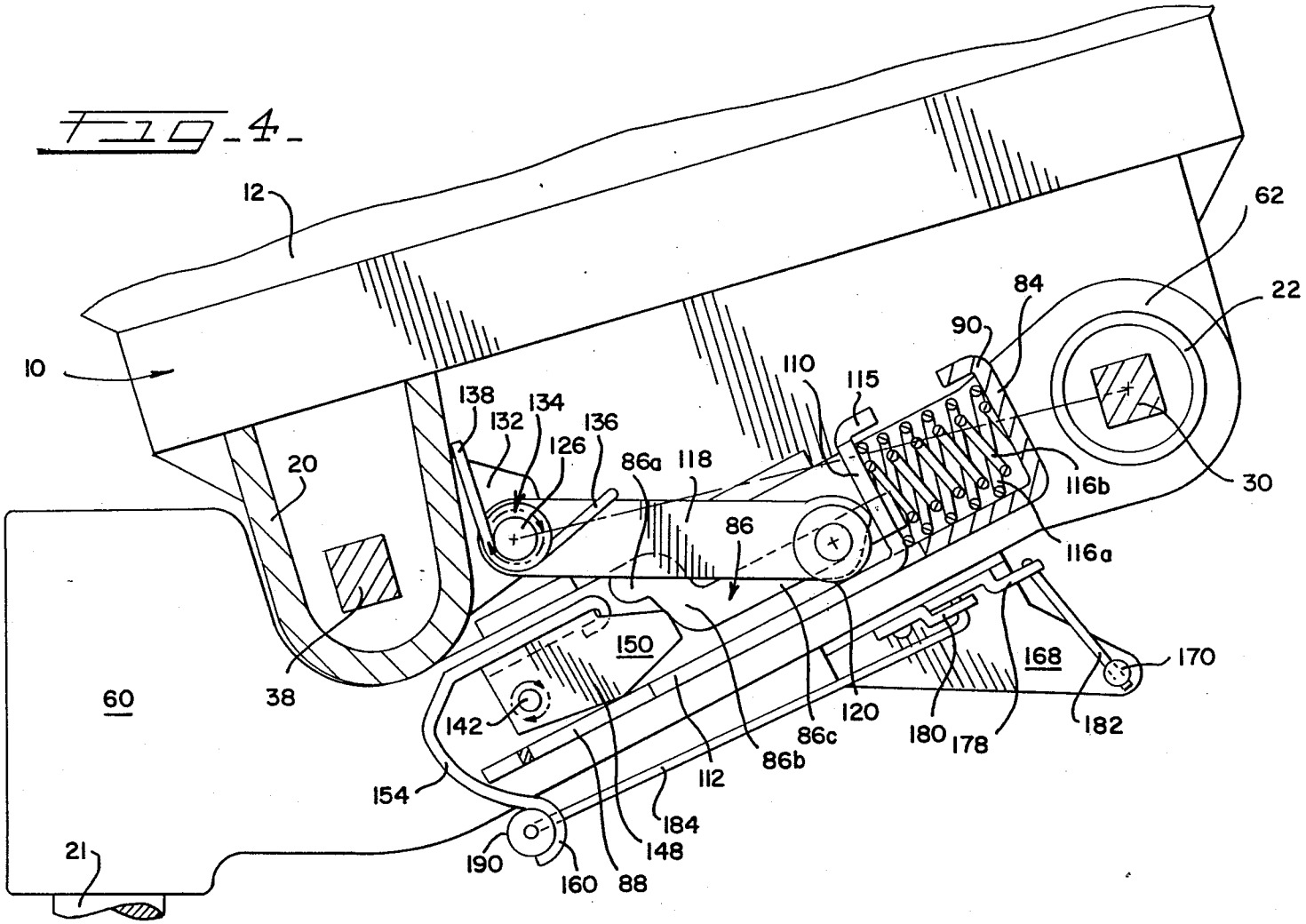
FIG. 4 is a side section of the support mechanism in the rear tilt position.
Figure 5:
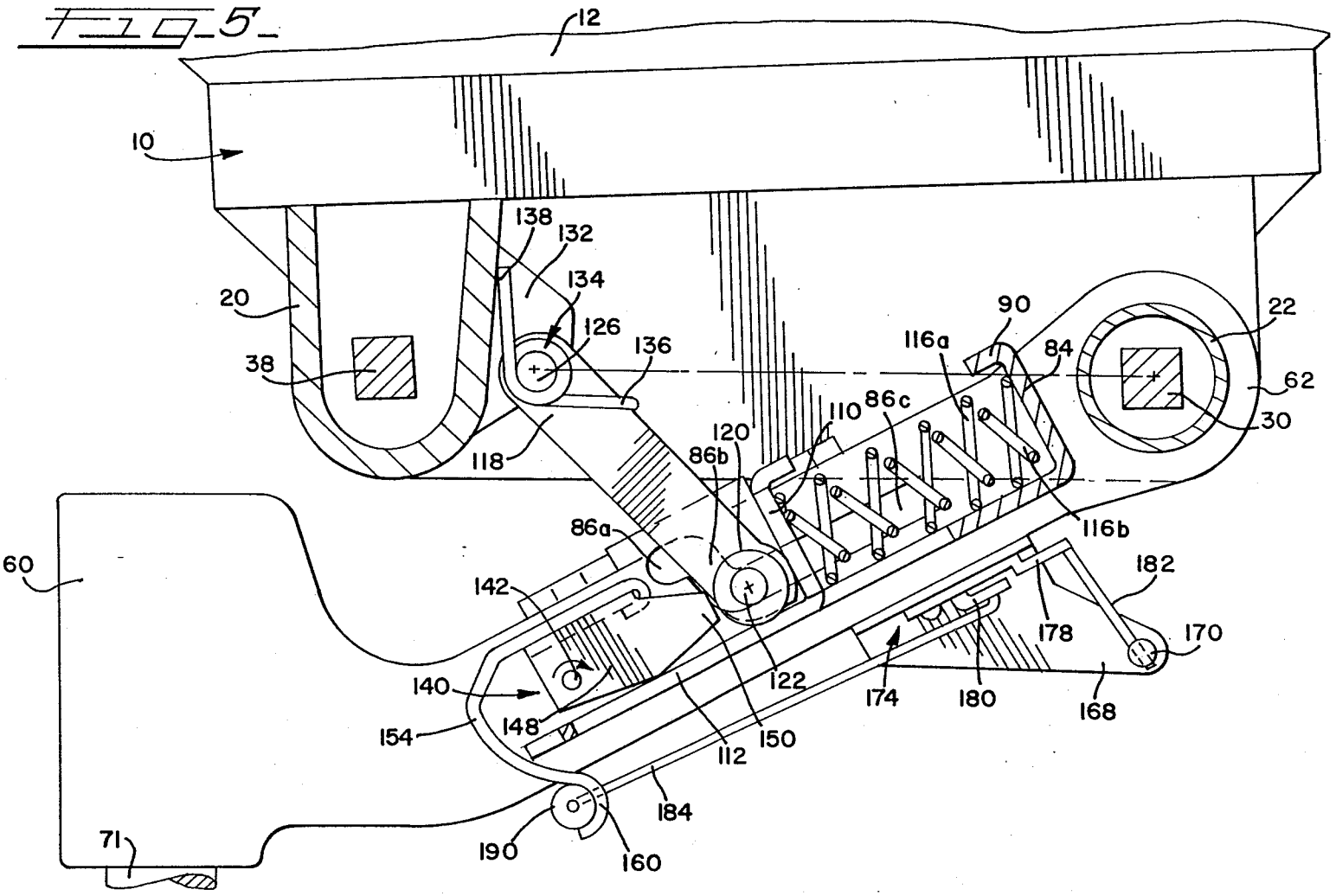
FIG. 5 is a side section of the support mechanism in the normal position.
Figure 6:
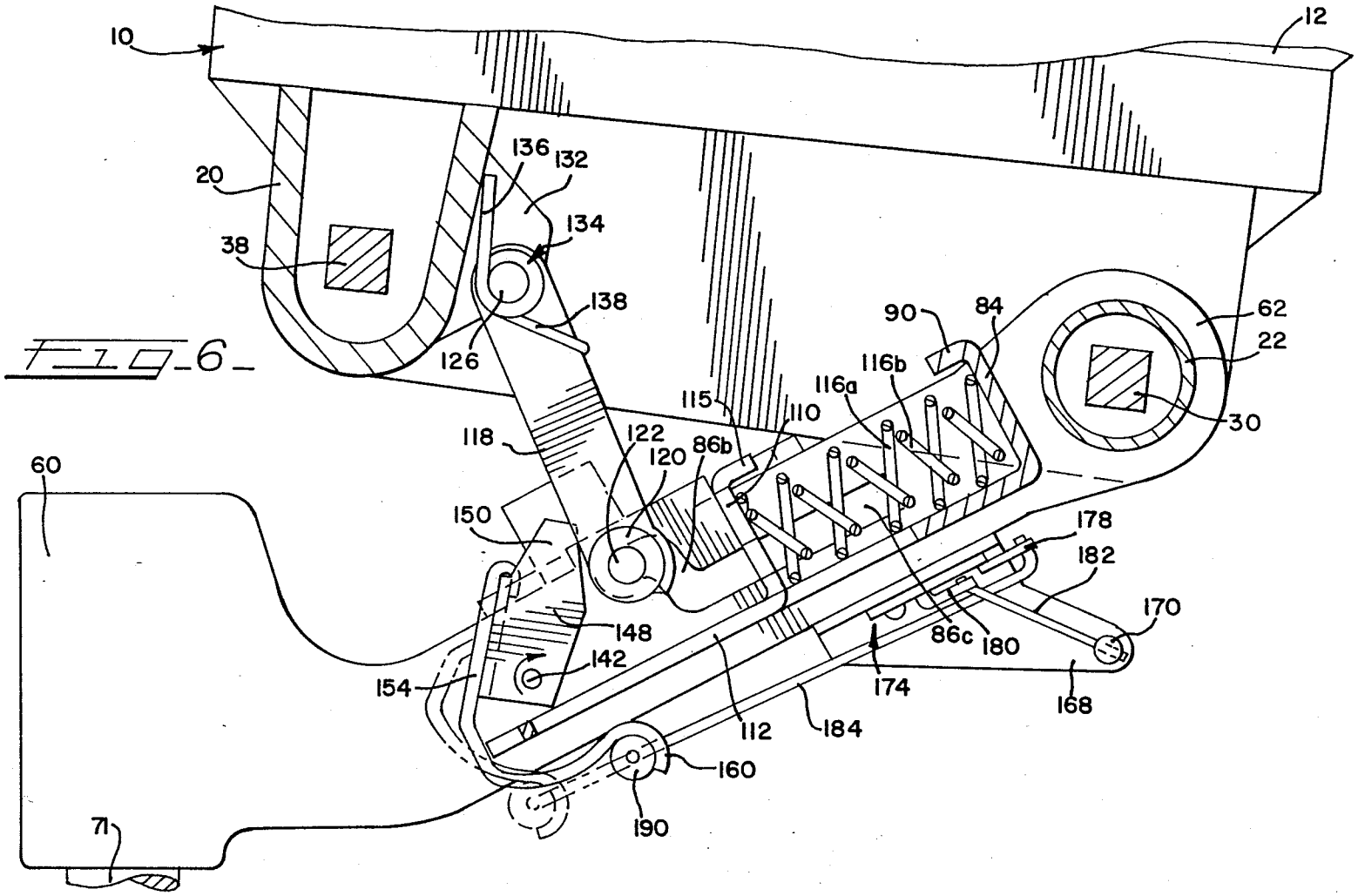
FIG. 6 is a side section of the support mechanism in the forward tilt position.

The rear portion of the base member 60 is provided with an opening 70 to receive a chair post 71, see FIGS. 4–6, which furnishes primary support for the chair and seat 12. The chair post 71 is usually supported at its lower end by some form of pedestal (not shown). The rigid connection between the chair post 71 and the base member 60 provides a relatively rigid support for the base member 60 and its connected components.

Figures 2, 3:
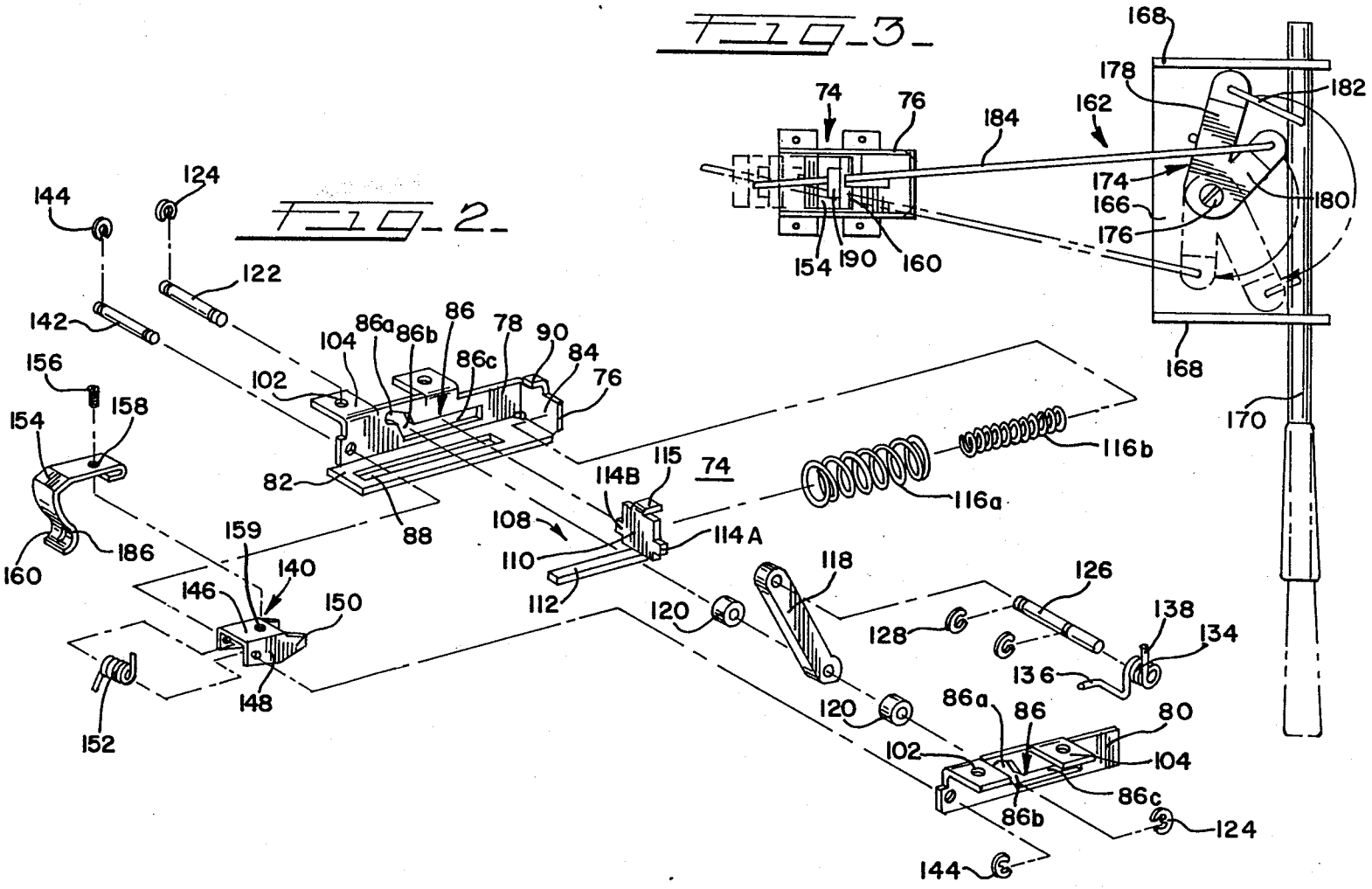
FIG. 2 is an exploded perspective view of the detent mechanism of the present invention.
FIG. 3 is a bottom view of the detent mechanism and its adjustment mechanism.

A recess or channel 72 is formed in the base member 60. A detent mechanism, generally indicated by the numeral 74, is secured within the recess 72. The detent mechanism 74 is provided to add stability to the support assembly 10 and to help resist rear tilt. Usually chair controls designed with front pivot and front rear tilt tend to tilt rearwardly as soon as someone sits on the seat. This action is not desireable and hence the detent mechanism 74 is interposed between the support assembly 10 and the base member 60 to add stability to the seat in the normal position and alleviate this problem. As best seen in FIG. 2, the detent mechanism 74 includes an integral housing 76 having a first side wall 78, a second side wall 80, a bottom wall 82 and an end wall 84. Each side wall 78, 80 defines a corresponding, opposing Z-shaped slot 86 having an upper portion **86*a*, a mid portion 86*b* and a lower portion 86*c*. A centrally defined slot 88 is provided through the bottom wall 82. A bent over flange 90 extends upwardly and rearwardly from the end wall 84. The housing 76 is secured within the base recess 72 by means of screws 100 which are inserted through apertures 102 defined through flanges 104 and into corresponding apertures 106 defined in the base member 60**.

A stop member 108 is slidably mounted within the housing 76 and is adapted to cooperate therewith. The stop 108 includes a vertical wall 110 having a leg 112 extending perpendicularly rearwardly therefrom. The leg 112 is slidably received in the base slot 88 of the housing 76. An arm 114 extends outwardly from each side of the wall 110 and slidably engages the side wall slots 86. A bent-over flange 115 extends upwardly and forwardly from the top of vertical wall 110. A pair of coaxial compression springs **116*a* and 116*b*, spring b positioned within spring a, are compressed between the end wall 84 of the first side wall 78 and the vertical wall 110 of the stop member 108. The bent-over flanges 90 and 115 retain the springs 116 therebetween. The stop leg 112 contacts the rear end of the base slot 88 to limit rearward movement of the stop member 108**.

The lower end of a link 118 is mounted between a pair of rollers 120 on a first cylindrical pin 122. The rollers 120 roll along the upper surface of the bottom wall 82 of the detent housing 76 on either side of the base member slot 88. The pin 122 is moveable within the side wall slots 86 from the upper portions **86*a* and through the mid portions 86*b* to the lower portions 86*c* and back again. Clips 124 secured to each of the ends of the pin 122 retain it in position within the side wall slots 86. The upper end of the link 118 is mounted on a second cylindrical pin 126. Clips 128 secure the second pin in place within a pair of apertures 130 defined within a pair of flanges 132 which depend outwardly from the front side of the U-shaped channel 20 of the support assembly 10. A helical torsion spring 134 is positioned about one end of the second pin 126. One end 136 of the torsion spring 134 is biased against the link 118 and the other end 138 is biased against the U-channel 20. The torsion spring 134, as viewed in FIG. 2, provides clockwise, downward force on the link 118**.

A pawl element 140 is pivotally attached to the rear end of the detent housing 76 by means of a pin 142. Clips 144 secure the pin 142 in place. The pawl 140 comprises a top 146 and a pair of downwardly depending side walls 148. A pair of arms 150 extend outwardly from the front ends of the side walls 148. A helical torsion spring 152 is centered on the pin 142 to bias the pawl 140 to the position shown in FIGS. 4 and 5. A lever 154 is attached to and cooperates with the pawl 140. The lever 154 is secured to the top 146 of the pawl 140 by means of a screw 156 which passes through aperture 158 in the lever 154 and is threadably engaged in aperture 159 defined in the top 146 of the pawl 140. The lever 154 defines a generally S-shaped portion 160 which extends downwardly therefrom beneath the undersurface of the base member 60 and cooperates with a release mechanism, generally indicated by the numeral 162 and best seen in FIGS. 1 and 3. The lever 154 may actually be considered part of the release mechanism 162.

The release mechanism 162 is mounted to the underside of the base member 60 by screws 164. It includes a top plate 166 having a side plate 168 depending downwardly from each side thereof. A wand 170 for effecting adjustment of the chair seat tilt control is movably supported through apertures 172 defined in the front ends of the side plates 168. As seen in FIG. 3, the wand 170 is movable between a first position shown in full line and a second position shown in phantom. A V-shaped bracket 174 is pivotally mounted to the underside of the top plate 166 by means of a screw 176. The bracket 174 includes a first arm 178 and a second arm 180 which is shorter than the first arm 178. The arm 178 is connected to the wand 170 by a first wire 182. The second arm 180 is connected to the S-shaped portion of the lever 154 by a second wire 184. The end of the wire 184 is inserted through a slot 186 in the S-portion 160 of the lever 154 and through an aperture 188 defined through a sleeve 190 which is supported thereby. Screws 192 are threadably received within openings 194 at each end of the sleeve 190 to grippingly engage the wire end and secure the end of the second wire 184 within the sleeve 190 and to the lever 154. Because of the interconnection via wire 182 of the wand 170 and the bracket 174, the bracket 174 is operable between a first, front tilt position which corresponds to the first position of the wand 170, and a second, normal position which corresponds to the second position of the wand 170.

FIGS. 4–6 of the drawings illustrate the operation of the chair seat tilt control. FIG. 5 shows the chair seat 12 in its normal position with the seat 12 generally horizontal. The arms 150 of the pawl 40 contact the link rollers 120, thereby preventing the first pin 122 from moving up through the mid portion **86*b* of the housing slot 86 and into the upper portion 86*a*, which is the front tilt position. The vertical wall 110 of the stop member 108 is urged by the coaxial compression springs 116 against the link 118, so the link 118 is held against movement. This results in a feeling of added stability and firmness to the chair seat 12** in the normal position.

When front tilt is desired, the adjustment wand 170 is pushed inwardly as indicated in FIG. 3. This moves the V-bracket 174 from the position shown in phantom to the position shown in full line. The pawl lever 154 is thus pulled forward via the second wire 184 as shown by full lines in FIG. 6, overcoming the biasing effect of the torsion spring 152 so that the pawl 140 is raised upwardly and the pawl arms 150 are out of contact with the link rollers 120. As seen in FIG. 6, when the person seated on the seat 12 leans forward, the first pin 122 moves from the lower portion **86*c* of the slot 86 through the mid portion 86*b* to the upper portion 86*a*, permitting forward tilt of the chair seat 12. Link 118, with first pin 122 biased by torsion spring 134 at position 82*a*, is either on center or slightly overcenter and therefore locked up. When someone is on the seat 12 and the wand 170 is pulled outwardly to the position illustrated in phantom in FIG. 3, the pawl spring 152 urges the pawl 140 downwardly so that the pawl arms 150 contact the link rollers 120 and move link 118 with first pin 122 out of the lockup position so as to enable the return of the first pin 122 to the lower portion 86*c* of the slot 86 as a result of the combined effort of pawl spring 152, pawl 140, pawl arms 150 and the chair occupant so that the seat 12 is again in the normal upright position shown in FIG. 5**.

When a person is in the seat 12 in the normal position, the detent mechanism 74 initially acts to resist rear tilt to provide a stable normal position. This is accomplished by the angle of the link 118 between the seat support assembly 10 and the detent housing 76 in the normal position, as shown in FIG. 5. The angle is such that the force applied by the coaxial springs 116 through the stop member 108 to the link 118 is increased four to five times, thereby adding to the resistance of the rear tilt torque mechanism 28. The link 118 has little mechanical advantage against the coaxial compression springs 116. When the person tilts rearward, the angle changes increasing the mechanical advantage of link 118 at a much faster rate than the force of the springs 116, thereby reducing and overcoming the force supplied by the springs 116 so that resistance to rear tilt is provided only by the rear tilt torque mechanism. Therefore the first pin 122 slides forward in the lower portion **86*c* of the slot 86, as seen in FIG. 4. The link 118 contacts the vertical wall 110 of the stop member 108 and forces compression of the springs 116, so that rear tilt is accomplished. The distance that the first pin 122 slides forward in the lower slot portion 86*c* depends on the amount of rearward force supplied by the person on the seat. As that amount of force decreases, the springs 116 urge the link 118 nearer to the mid portion 86*b* of the slot 86**, or the normal position.

Thus, it has been shown that the present invention provides a seat support mechanism for a tiltable chair including a detent mechanism to add stability to the chair seat when the chair seat is in its normal upright position and to increase the resistance of the torque mechanism.

Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. A support mechanism for a tiltable chair including a seat support assembly having a front and a rear adapted to be mounted to the underside of a chair seat, said support assembly including a pair of side plates; a tube having a central axis supported between and toward the front ends of said side plates such that said support assembly and said tube are relatively rotatable; a rear tilt torque mechanism associated with said seat support assembly operative to resist rear tilt of said seat support assembly about said tube; a rear tilt torque adjustment means connected to said rear tilt torque mechanism to selectively vary the resistance to rear tilt; a base member having a rear end which is adapted to be supported by a chair post and a front end which is rigidly securable to said tube; a detent mechanism connected between said base member and said support assembly to bias said support assembly to a horizontal position and to provide added resistance to rear tilt, said detent mechanism adapted to assume a first position such that rear tilt of said support assembly about said tube is permitted, but front tilt of said support assembly about said tube is prohibited, said detent mechanism further adapted to assume a second position to allow forward tilt of said support assembly about said tube; and a release mechanism associated with said detent mechanism operative to lock said detent mechanism in said first position and to selectively release said detent mechanism to assume said second position.

2. The support mechanism of claim 1 wherein said detent mechanism includes a resilient biasing means adapted to bias said support assembly to said horizontal position.

3. The support mechanism of claim 2 wherein said detent mechanism includes a housing, a stop member slidably received within said housing, said biasing means biased between said stop member and said housing, a link member, the lower end of which is slidably connected to said housing and the upper end of which is pivotally secured to said seat support assembly, a pawl element pivotally mounted within said housing and biased downwardly such that when said chair seat is biased in said horizontal position, said lower end of said link is locked between said pawl element and said stop member.

4. The support mechanism of claim 1 wherein said rear tilt torque mechanism includes a first torsion bar and a second torsion bar, said first torsion bar extending through said tube, one end of said first torsion bar non-rotatably supported within one end of said tube and the other end rotatably supported within said seat support assembly, said other end of said first torsion bar connectable to a first bracket, said second torsion bar extending between and rotatably supported between the rear ends of said side plates and having one end connectable to a second bracket, said first and second brackets interlockable such that said first and second torsion bars cooperate to resist rear tilt of said seat support assembly about said tube.

5. The support mechanism of claim 1 wherein said release mechanism includes a lever attachable to said pawl element, a bracket pivotally mounted to said undersurface of said base member and moveable between a first position and a second position, said bracket connected to an adjustment element and to said pawl element, said adjustment element operable between a first position corresponding with said first position of said bracket and a second position corresponding with said second position of said bracket, whereby when said bracket is moved from said second position to said first position, said pawl element is raised upwardly overcoming the biasing effect of said helical torsion spring so that front tilt is permitted.

6. The support mechanism of claim 1 wherein said rear tilt torque adjustment means includes a bracket, one end of which is attachable to one of said torsion bars and the other end of which defines a collar adapted to receive a threaded element, the tip of which contacts the underside of a flange depending outwardly from a corresponding side plate of said seat support assembly, a knob associated with said threaded element whereby when said knob is rotated, the torque resistance to rear tilt is adjusted.

* * * * *